United States Patent [19]

Walker et al.

[11] Patent Number: 4,729,438

[45] Date of Patent: Mar. 8, 1988

[54] STABILIZER FOR NAVIGATIONAL DRILLING

[75] Inventors: Clyde R. Walker, Spring, Tex.; Burley Glasscock; Haraldur Karlsson, both of Sandy, Utah

[73] Assignee: Eastman Christensen Co., Salt Lake City, Utah

[21] Appl. No.: 881,951

[22] Filed: Jul. 3, 1986

[51] Int. Cl.[4] ..... E21B 7/08

[52] U.S. Cl. ..... 175/76; 175/325

[58] Field of Search ..... 175/76, 325; 166/241

[56] References Cited

U.S. PATENT DOCUMENTS

| | | | |
|---|---|---|---|
| 2,919,897 | 1/1960 | Sims | 175/76 |
| 3,145,785 | 8/1964 | Kellner | 175/76 |
| 3,420,323 | 1/1969 | Owens | 175/325 |
| 4,396,234 | 8/1983 | Garrett | 175/325 |
| 4,526,241 | 7/1985 | Anders | 175/76 |
| 4,610,316 | 9/1986 | Boaz | 175/325 |

*Primary Examiner*—Stephen J. Novosad
*Assistant Examiner*—William P. Neuder
*Attorney, Agent, or Firm*—Beehler, Pavitt, Siegemund, Jagger, Martella & Dawes

[57] ABSTRACT

A stabilizer for use in controlled directional drilling includes a plurality of spaced and axially extending blade elements each having a blade surface face of hardened material. The blade surface face includes a tapered lead portion and a tapered trailing portion with a flat non-tapered surface face portion therebetween. Each blade surface includes an edge portion in which the leading edge is radiused. Thus constructed, the stabilizer reduces kerfing into the formation and hang-up and change of tool face orientation during navigational drilling. Eccentric stabilizers are also described.

17 Claims, 15 Drawing Figures

Fig. 7
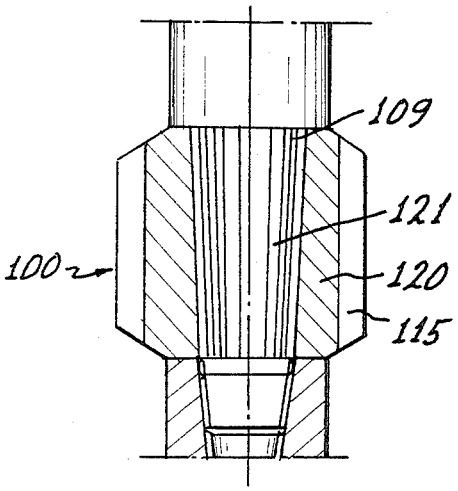
Fig. 8
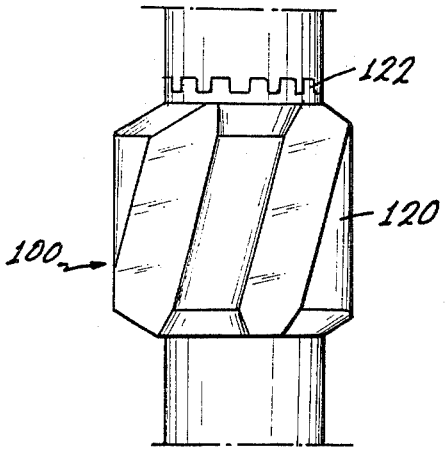
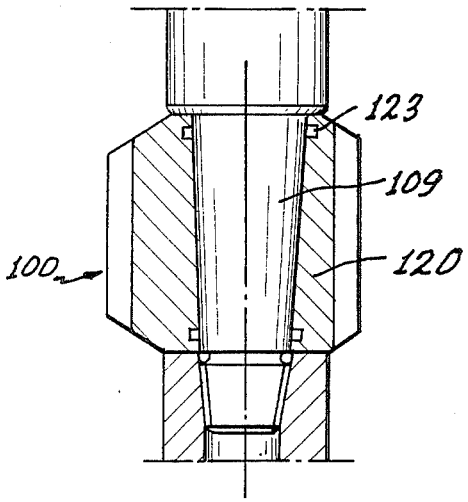
Fig. 9
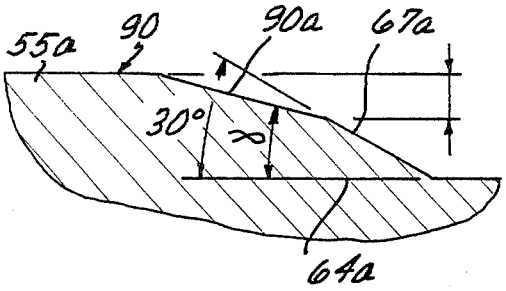
Fig. 5a
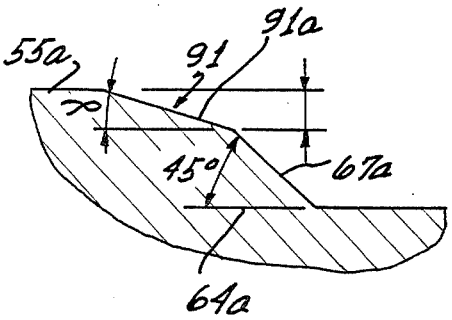
Fig. 5b Fig. 10
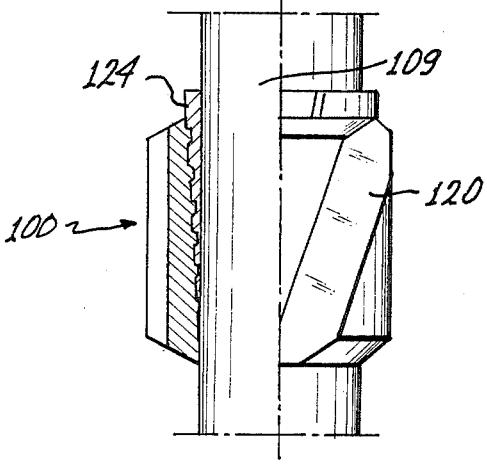
Fig. 11
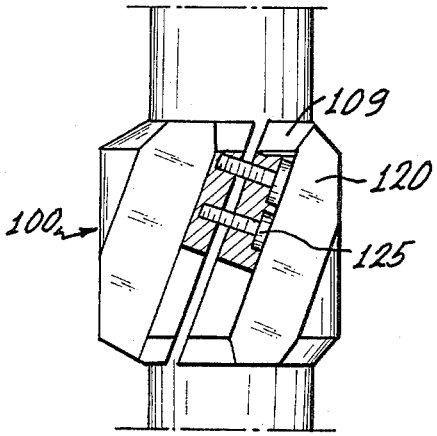
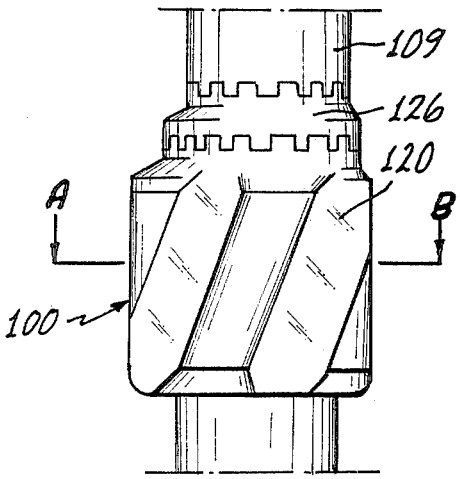
Fig. 12
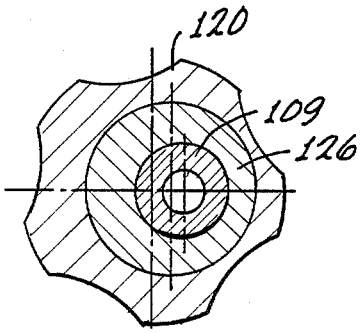
A-B
Fig. 13

STABILIZER FOR NAVIGATIONAL DRILLING

FIELD OF THE INVENTION

This invention relates to an improved stabilizer construction and more particularly to an improved stabilizer for use in navigational drilling and what is sometimes referred to as controlled directional drilling.

DESCRIPTION OF THE PRIOR ART

Various devices are known in the prior art for navigational or controlled directional drilling systems. These systems offer the advantage that straight holes or navigational or controlled directional drilling can be accomplished without tripping. In general this is accomplished by an assembly on the lower end of the string, i.e., a bottom hole assembly, which basically includes some form of downhole power source such as a downhole motor or the like. This lower section includes a drill bit connected to be rotated by the motor or by rotation of the drill string or both.

Normally, the lower end of the string, below the motor includes an assembly which orients the drill bit face at an angle. The lower end of the string also includes an upper and lower stabilizer assembly, one above the motor and the other at essentially the location of the lower bearing, the latter usually located below U-joint housing (or other similar structure) which, in turn is below the motor or other downhole power source. By rotating the bit by the motor and by simultaneously rotating the string, the hole is drilled straight. To drill at an angle, or along a predetermined radius of curvature, rotation of the string is stopped, the drill string is raised slightly to lift the bit off the bottom, and the face of the bit is oriented in the proper direction as determined by appropriate reference marks or the like. For controlled directional or navigational drilling, the bit is then rotated only by the motor.

Typical prior systems are those described in U.S. Pat. Nos. 4,465,147; 4,485,879 and 4,492,276. Reference is also made to U.S. application Ser. No. 731,181, filed May 6, 1985 and assigned to the same assignee. Quite obviously, accuracy and control of the borehole trajectory in terms of the desired target is important. It is equally apparent that an important portion of the operation is the phase involving raising the string, orienting the bit face correctly and lowering the string to an operating position while maintaining bit face orientation.

One of the problems which has been noted in the navigational drilling or controlled directional drilling operation is that the lower assembly, i.e., that from the upper stabilizer and the components below that unit, tends to hang-up in the borehole as the change is made from straight drilling to the directional mode of drilling. In the straight driling mode the string is rotated and the stabilizers are also rotated by the string and therefore there generally is no hang-up. The use of stabilizers is desirable in order to have precise stabilization and to control the constant radius arc to be drilled in the directional mode. In effect, the tilt of the drill bit axis is related to angles formed by lines drawn perpendicular to the top stabilizer-bottom stabilizer components and from the bottom stabilizer to the bit, all of which is fully set forth in the pending application previously identified and to which reference is made.

As noted, in going from the straight to the directional or orientational mode, it is necessary to lift the bit off the bottom by raising the string in order to orient the inclined face of the bit in the proper and controlled orientation. With the stabilizers heretofore in use, one problem which has been noted is that the bottom hole assembly hangs up in the borehole as the string is raised. This is believed due to the fact that as the string is raised the blades of the stabilizer dig into the formation. After the bit face is properly oriented, the string is lowered so that orientational or navigational drilling may proceed.

In the directional mode, the string is not rotated and thus the stabilizers are not rotated. It has been noted that because the string is not rotated, presently necessary to maintain proper bit face orientation, the lower end of the drill string (BHA) may not slip down the hole and hangs up in the hole about one to two feet off the bottom. The string can be broken free by the addition of weight to the string, e.g., 40,000 or more pounds, but when this weight is added to break free the string, the breaking free action is sometimes sudden and the bit tends to bottom in the hole, while the added string weight tends to cause the motor to stall. When this happens, there may be damage to the motor. In any event, it is necessary to start the orientation phase all over again.

Another problem which has been noted is that in lowering the string at the start of navigational drilling, the string must not be rotated since bit face orientation must be maintained for accurate direction control. It has been noted, however, that in the lowering there tends to be a loss of desired bit face orientation. It is believed that this adverse rotation and loss of orientation is the result of the edges of the stabilizer blades being caught by the formation, especially in softer formations.

SUMMARY OF THE INVENTION

In accordance with the present invention, the above described problems are overcome by the use of an improved stabilizer and stabilizer assembly for use in a bottom hole assembly used in navigational drilling and in controlled directional drilling in which the unit is a tilted drive sub or a double tilted U-joint sub or any of the other arrangements used to orient or angularly position the bit face for use in navigational and controlled directional drilling, for example, a bent sub.

The stabilizer assembly includes at least one stabilizer unit, and preferably spaced stabilizer units located such that one is above and adjacent to the motor or downhole power source, and the other is located at or near the lower bearing housing which is immediately above the bit and which bearing housing supports the lower bearing assembly for the driven shaft which is driven by the motor, preferably a positive displacement motor, and which is connected to rotate the bit.

Each stabilizer includes a plurality of blades, of a unique configuration to be described, each blade including a blade surface having a leading and trailing edge. The trailing edge of the blade surface face is trailing only during rotation of the stabilizer. When the stabilizer does not rotate, i.e., the non-rotary mode, and the string moves downwardly in the borehole, that trailing edge of the blade surface face effectively becomes a leading edge of a nonrotating stabilizer. In the non-rotary mode, it is the rotating trailing edge but non-rotating leading edge of the blade surface face that tends to kerf into the formation, causing the hang-up and loss of the desired bit face orientation described.

In accordance with this invention, the downhole end or leading portion of the stabilizer blades includes blade surface faces which are tapered in an axial direction to the about the outside diameter of the associated component, e.g., the bearing housing or the upper support structure. This tapering of the blade surface face assists in downward and free movement of the BHA through the borehole. The trailing portion of the stabilizer blade surface faces are also tapered, but not as much as the leading portion, to facilitate raising of the string without hang-up. Further, the edge of the blade surface face of each of the blades is radiused to assist in sliding down the borehole without kerfing into the formation, thus avoiding hang-up in the orientation mode and avoiding a twist or rotation which takes the bit face out of orientation.

The stabilizer may be any of a variety of configurations for assembly to or on the drill string, provided the blades of the stabilizer are constructed to eliminate the hang-up as described above.

It is thus an object of the present invention to provide an improved stabilizer, and especially a stabilizer configured to eliminate hang-up when used as a component of a navigational or controlled directional drilling system.

Another object of this invention is the provision of a improved stabilizer assembly which is especially useful in drilling operations in which bit face orientation is important for accurate control of the borehole course and which eliminates hang-up in orienting the bit face and which prevents hang-up in lowering the string and which prevents loss of bit face orientation.

The above and other objects of the invention will be made clear to those skilled in the art from the following detailed description which is to be considered as illustrative of the present invention, rather than as limiting the present invention.

BRIEF DESCRIPTION OF THE DRAWINGS

FIG. 5*a* is a fragmentary sectional view of another configuration of the leading end of the stabilizer in accordance with the present invention;

FIG. 5*b* is a fragmentary sectional view of still another configuration of the leading end of the stabilizer of this invention;

FIG. 7 is a view, partly in section and partly in elevation, of one form of eccentric stabilizer in accordance with this invention;

FIG. 8 is a view similar to FIG. 7, but illustrating another form of eccentric stabilizer;

FIG. 9 is a view, partly in section and partly in elevation of another form of eccentric stabilizer in accordance with the present invention;

FIGS. 10 and 11 are diagrammatic views of other forms of stabilizers in accordance with this invention;

FIG. 12 is a view in perspective of another form of eccentric stabilizer in accordance with this invention; and FIG. 13 is a view in section taken along the line 13—13 of FIG. 12.

DETAILED DESCRIPTION OF THE INVENTION

Figure 1:
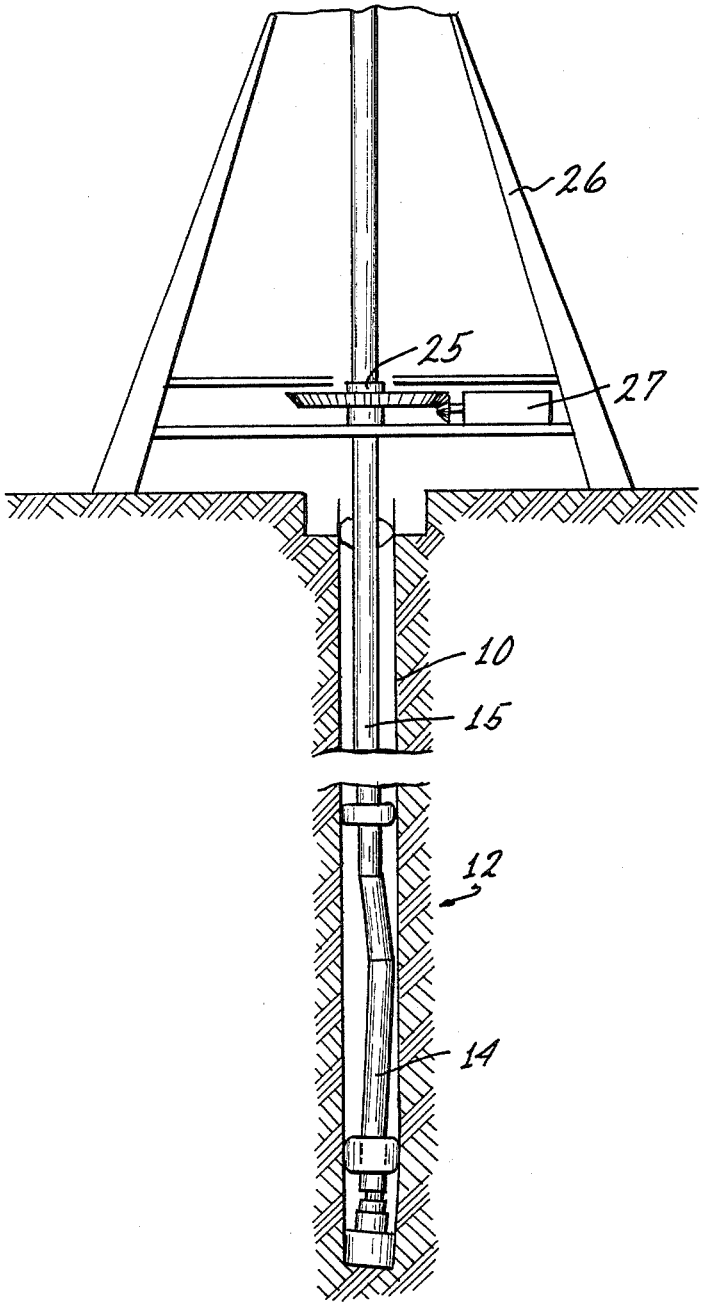
FIG. 1 is a diagrammatic illustration of one form of driling device for use in controlled directional drilling or navigational drilling of a borehole in accordance with the present invention.

Referring to FIG. 1 which illustrates a representative controlled directional drilling or navigational drilling system in accordance with this invention, positioned within a borehole 10 is a drilling system 12 which includes a bottom hole assembly (BHA) 14 used for the type of drilling described. For purpose of explanation, the BHA is as described in the above identified application, but other types of bottom hole assemblies may be used, as is known in the art, for example, tilted drive subs and bent subs.

The BHA 14 is connected to a drill string 15 in the usual manner, the string 15 being arranged to be rotated by a turntable 25 mounted on a derrick 26 in the usual fashion. The turntable 25 includes a locking device 27 to prevent rotation of the turntable and the drill string 15. The locking device 27 controls the rotation of the drill string 15 to permit, for example, a continuous rotation or limited rotation for alignment purposes as previously described. When in the locked position, the locking device 27 prevents rotation of the drill string 15 and the bottom hole assembly 14. Although not illustrated, the portion above the BHA may include a measurement while drilling unit (MWD) for telemetering information about downhole conditions and bit orientation to the surface. Such MWD systems and the information transmitted to the surface are themselves well known in the art.

Figure 2:
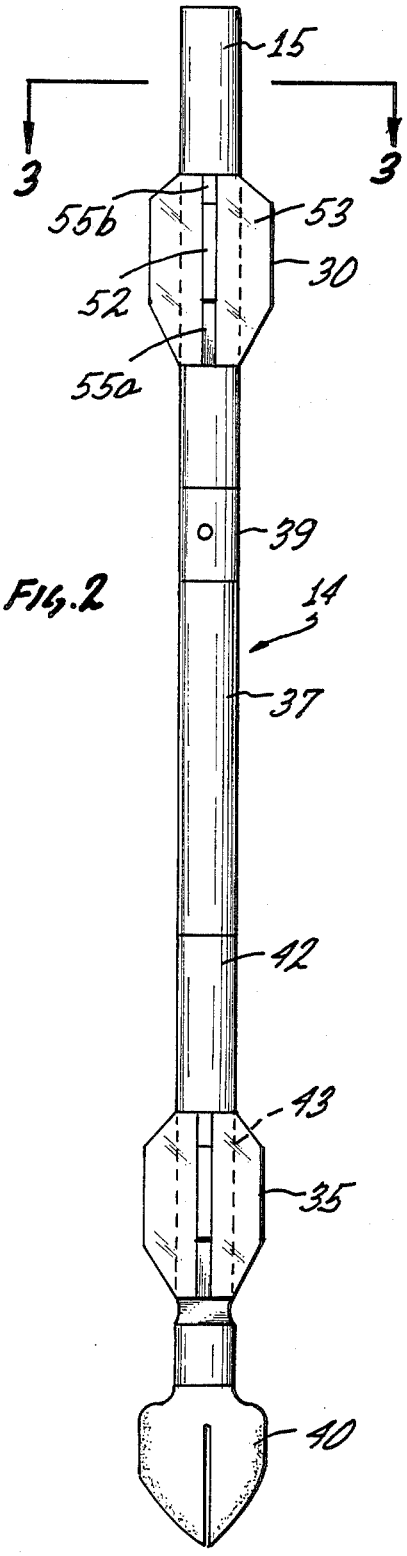
FIG. 2 is a schematic illustration of a bottom hole assembly incorporating the improved stabilizer of the present invention.

Referring to FIG. 2, the BHA 14 schematically illustrated in FIG. 1 includes an upper stabilizer 30 and a lower stabilizer 35 located at the lower end of the BHA, the latter connected to the drill string 15 as mentioned previously. Below the upper stabilizer 30 is a motor section 37 which may house a downhole motor, for example, any one of several commercially available positive displacement pumps of the Moineau type. Turbine motors, vane motors or electrical motors may be used, but the Moineau-type motor is preferred. Above the motor section 37 and below the upper stabilizer 30 is a standard by-pass valve 39 typically used with positive displacement pumps.

The motor rotor, not shown, is connected to drive a drill bit 40 at the lower end of the bottom hole assembly. Below the motor section 37 is a U-joint section 42, with the lower bearing housing 43 being located below the U-joint section and at about the location of the lower stabilizer 35. The lower bearing housing 43 may be at an angle with respect to the motor section 37, the latter being preferably in axial alignment with the drill string 15. The portion of the bottom hole assembly below the motor may be a double tilted U-joint assembly of the type described in the application previously referred to or it may be a tilted drive sub with a single tilted U-joint. A bent sub which effects inclination of the bit fact at a known angle may also be used. The use of a double tilted U-joint is preferred because of the decreased offset from the bit to the by-pass valve and the reduced bending forces and frictional forces when initially tripping and when rotating the string. In effect, any arrangement may be used which brings about an inclination of the bit face by a known angular displacement.

Figure 4:
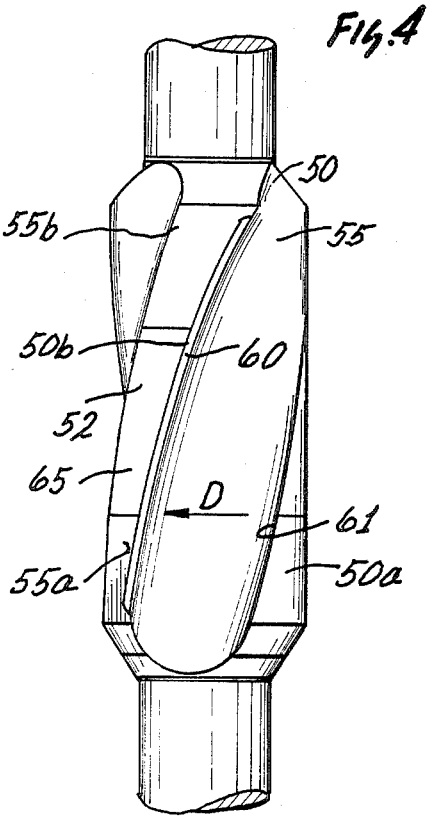
FIG. 4 is a diagrammatic view of the improved stabilizer of the present invention.
Figure 3:
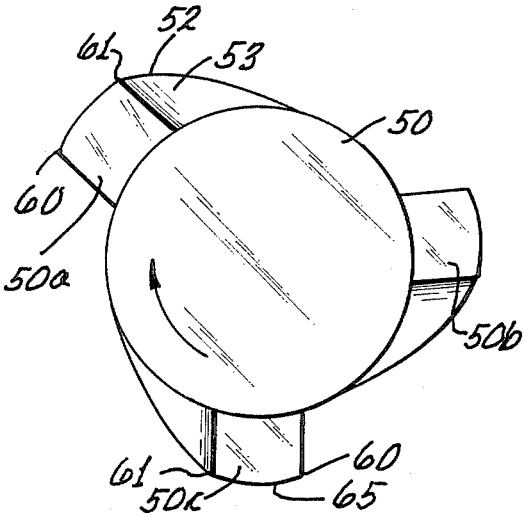
FIG. 3 is a view partly in section and partly in elevation as seen along the line 3—3 of FIG. 2.

Referring now to FIGS. 3 and 4, the stabilizer 50 includes a plurality of blades, three being illustrated as 50*a*, 50*b* and 50*c*, by way of example. Since the stabilizers 30 and 35 are of essentially the same essential configuration, the detailed explanation will be made with reference to stabilizer 50. The blades 50*a*–50*c* are radially spaced and extend generally axially and are spiraled in the general form of a helix. A right hand spiral may be used, for example. Each blade includes a surface face 52 located radially outwardly of a blade body 53, the latter mounted, as to be described, on a supporting structure which may be any of several different types known in the art or as describe herein.

Each blade surface face 52 includes a leading tapered portion 55*a* and preferably a trailing tapered portion 55*b*, each to be described in detail, the leading portion being that which enters the borehole first or which is closest to the bit 40, see FIG. 2, for example. The blade surface faces 52 each include a trailing and leading edge, 60 and 61, respectively, the portion between the trailing and leading edges forming the blade surface face 52 which is slightly arcuate as viewed radially and which surface face extends axially in a generally spiraled orientation.

As noted earlier, the designation leading edge and trailing edge may sometimes be confusing since in fact the trailing edge of a rotating stabilizer may function as the leading edge of an axially moving and non-rotating stabilizer. Also to be considered is the direction of the spiral. Thus, as seen in FIG. 4, as the string and the stabilizer rotate in the direction of the arrow D, edge 61 is the leading edge since the spiral is right hand while edge 60 is the trailing edge. It will be appreciated that if the spiral is left handed, the the reverse is true. It is also apparent from FIG. 4 that as the BHA moves axially in a non-rotating string mode, edge 60 becomes the leading edge while edge 61 becomes the trailing edge. Again, for a left hand spiral, the reverse is true. It is to be noted that although the stabilizers 30, 35 and 50 are illustrated as centered, the present invention is also applicable to and contemplates the use of eccentric stabilizers, as will be discussed.

Figure 5:
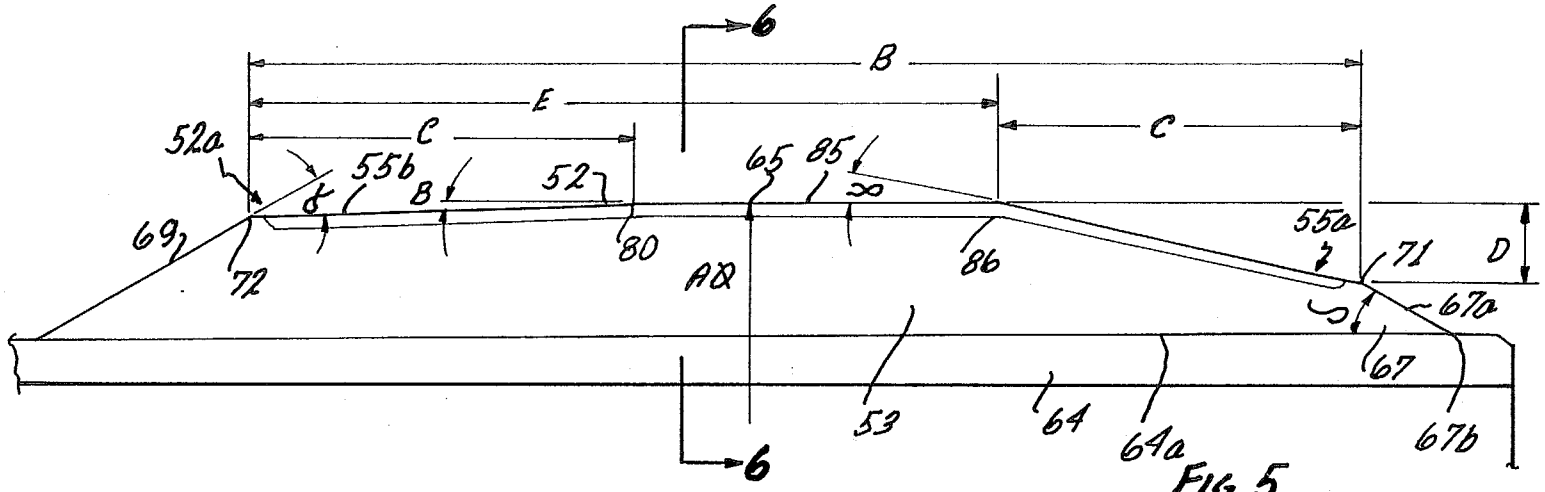
FIG. 5 is an sectional view illustrating the various dimensions of a stabilizer in accordance with a preferred form of the invention.
Figure 6:
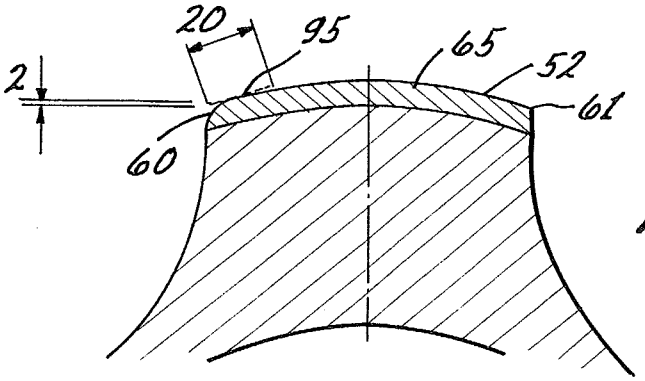
FIG. 6 is a sectional view taken along the line 6—6 of FIG. 5.

Referring to FIGS. 5 and 6, the details of the stabilizer are illustrated, and the same reference numerals have been applied as in FIGS. 3 and 4, where applicable. Essentially the entire surface face 52, which essentially includes the tapered leading portion 55*a* and tapered trailing portion 55*b*, and which are supported on the body 53 mounted on the support 64, is formed with a hard facing or of abrasion resistant material, indicated at 65, as is known in the art. Typically this is a tungsten carbide material or some other suitable form of hardfacing and preferably extends along the surface face 52 including the tapered portions thereof. For purposes of explanation the surface 64*a* of the support 64 may be used as a reference for some of the dimensions.

For example, the diameter of the stabilizer as measured from blade surface face to opposed blade surface face may vary from $4\frac{3}{4}$ inches to $2\frac{3}{4}$ inches, depending upon to diameter of BHA at the motor section and the diameter of the borehole. Typically the diameter of the stabilizer across the blades is slightly less than the borehole diameter, for example, by $\frac{1}{8}$ to $\frac{1}{4}$ of an inch depending upon the diameter.

Forward of the leading tapered portion 55*a* of the blade surface face 52 is a tapered forward lead end 67 of the blade body 53 and which need not be hardfaced. The angle delta, between the reference surface 64*a* and the surface 67*a* of the tapered lead end 67 is preferably between 30 degrees and 45 degrees, for example. To the rear of the trailing tapered portion 55*b* of the surface face 52 is a tapered trailing end 69 of the blade body which, again, need not be hardfaced. The angle alpha between the surface of the surface face 52 between the tapered trailing portion 55*b* and the surface 69*a* may be between 30 degrees and 45 degrees. As shown, surface 67*a* intersects the leading tapered portion at 71 and the tapered trailing portion intersects surface 69*a* at point 72. The axial dimension B of the face between 71 and 72 may be between 246 mm to 540 mm. The radial dimension between point 71 and the intersection 67*b* with the surface 64*a* may be about 0.5 mm. All dimensions herein give are representative and illustrative, and depend upon the the tool diameter and borehole diameter.

The axial dimension C of the tapered leading portion 55*a* of the surface face 52 may be between 82 mm and 180 mm, as measured from point 71 to point 80, the latter forming the start of that point at which the surface face 52 includes an essentially axially flat face portion 85. The angle gamma, between the flat face portion 85 and the tapered leading portion, may be in the range of between 6 degrees and 15 degrees. Dimension D, which represents the radial dimension from point 71 to 86 may be between 11.5 mm and 55 mm, for example. The dimension E, from point 72 to point 86 may be between 164 mm to 360 mm. The flat face portion ends at point 80 which is the start or leading end of the tapered trailing portion 55*b*. The dimension C from point 86 to point 71 may be between 82 mm and 180 mm, i.e., essentially the same as the dimension from point 72 to 80. Angle beta, which is the angle between the flat face portion 85 and the tapered trailing portion, as measured from point 80, is between 1 degree and 4 degrees, but 2 degrees is preferred.

It is preferred that the axial dimension of the tapered leading portion 55*a* and that of the trailing tapered portion 55*b* and the flat face portion 85 be essentially the same. So dimensioned, the surface face 52 is formed of three segments, the leading tapered portion 55*a*, the intermediate flat face portion 85 and the trailing tapered portion 55*b*. As already described, the leading tapered portion 55*a* is preferably tapered to a greater extent than the trailing tapered portion 55*b* in order to facilitate lifting the BHA and to prevent hang-up when the BHA is lowered, after orienting the bit face.

The rib angle, i.e., the angle of the stabilizer blade and effectively the helix angle may be between about 18 degrees and 30 degrees. Above about 40 degrees the helix angle becomes too steep and the stabilizer tends to hang-up. The wrap of the helix, i.e, the circumferential extent to which the blades encircle the extend around the periphery, may be between about 190 degrees and 390 degrees, this measurement being from the start of the flat portion 85 of the face to the end of the trailing portion 55*b*, essentially dimension E from point 86 to point 72, alhough other wraps may be used. It is also understood that the number of blades may vary, but three or four blades is preferred in accordance with this invention.

FIG. 5*a* illustrates a modified form of stabilizer 90 in which the configuration of the leading tapered portion of the blade surface face is different from that described. In this form, there is an inclined step 90*a* forward of the leading tapered end 55*a*, the inclined step being hardfaced as described. The dimension A may be between 10 to 30 mm, for example, with the angles being as indicated.

The stabilizer illustrated in FIG. 5*b* illustrates still another form of the leading tapered portion of the blade surface face. In this case there is also an inclined step 91*a* which is hardfaced forward of the leading tapered end 55*a*. Dimension A may be 40 mm, for example. This form of leading end is typically used for the larger diameter stabilizer units.

Referring to FIG. 6, the radial contour of the blade surface face 52 is illustrated. As shown, the surface 52 is curved and hardfaced as indicated at 65. The trailing edge is radiused as shown at 95 along at least the flat non-tapered surface face portion and preferably along the entire edge of the blade face. The radiusing may extend from 10 to 30 mm from the edge, with 20 mm being preferred and the radial dimension may be from 1 to 5 mm with 2 mm being preferred. The radiusing of the non-rotary leading edge 60 operates to cam the non-rotating leading edge relative to the formation as the stabilizer is moved axially in the borehole for the reasons already described.

The stabilizer 100 of FIG. 7 is configured as already described and includes a carrier body 109 in which the blades 115 are in the form of a ribbed shell 120 fixed to a carrier body by a positive connection. This form of stabilizer is illustrated as eccentric, although it may be concentric, as is true of the other forms of stabilizer to be described. The ribbed shell 120 can be aligned stepwise relative to the carrier body 109. In the form shown in FIG. 7, the positive connection between parts 109 and 120 is formed by splines 121, while in the form shown in FIG. 8, the positive connection is by radially arranged teeth 122. It is apparent that these forms lend themselves to an eccentric stabilizer having the blade configuration as previously described.

The forms shown in FIGS. 9 to 11 enable the ribbed shell 120 to be interchanged and, in the case of an eccentric stabilizer, provide for continuous adjustment relative to the carrier body 109. Thus these forms are shown as an eccentric stabilizer, but the interchangeable feature of the structure permits use in other forms of stabilizer, i.e., concentric.

In FIG. 9, the ribbed shell 120 is fixed by an interference fit which is achieved by applying hydraulic pressure to expand the ribbed shell 120 forcing it onto the carrier body and thereafter relieving the pressure load on the ribbed shell. The shell may be provided with seals 123, as shown.

FIG. 10 shows an arrangement by which the ribbed shell 120 may be fixed by the use of a longitudinally slotted intermediate shell 124 which provides a conical threaded area to the ribbed shell 120. When screwed together the intermediate shell 124 locks the ribbed shell 120 to the carrier body 109. The form shown in FIG. 11, includes a ribbed shell 120 which is slotted along a rib and is clamped to the carrier body 109 in the manner of a clamping collar and by several screws 125.

Where it is desired to have a stabilizer 100 with a selected preset eccentricity, the form illustrated in FIGS. 12 and 13 may be used. In this form, the stabilizer includes a carrier body 109 and a ribbed shell 120, but also includes an intermediate shell 126. By rotating the ribbed shell 120 relative to the intermediate shell 126, the eccentricity of the stabilizer 100 may be changed stepwise form a minimum to a maximum, while retaining the alignment of the ribbed shell 120 relative to the carrier body 109. The parts may be fixed by the radially arranged teeth, as described with reference to the form illustrated in FIG. 8.

It is also apparent that other forms of eccentric arrangements may be used, for example, one in which the bore is arranged eccentrically with respect to the axis of the drill string. Further, the use of two stabilizers is preferred for the reasons that the spaced support and the relative distance from the top stabilizer to the lower stabilizer and the distance from the lower stabilizer to the bit may be arranged to provide a desired radius of curvature, as explained in detail in the application to which reference has previously been made. It is apparent that an eccentric form of stabilizer may be used, as described in the patents and application to which reference has previously been made. It is understood, however, that the blade surface configuration is as described in connection with FIGS. 5, 5*a*, 5*b* and 6, in order to prevent hang-up in lifting the string, hang-up in lowering the string and loss of bit face orientation, as described. As noted in the patents, and especially the application to which reference has been made, there are advantages in certain circumstances in using an eccentric stabilizer.

It will be apparent to those skilled in the art from the foregoing detailed description that may variations and modifications may be made which will come within the scope of the present invention as set forth in the appended claims.

What is claimed is:

1. In a stabilizer for use in a bottom hole assembly for use in navigational or controlled directional drilling in which there is a bit on the lower end of the string with a bit face oriented at an angle with respect to the axis of the drill string and wherein there is a tendency for the stabilizer to hang-up or kerf into the formation at the start of or during directional drilling, the improvement comprising:

a plurality of spaced and generally axially extending and spiraled blade elements each including a surface face of a hardened abrasion resistant material, each said surface face having a trailing and leading edge portion, each blade having a surface face also including a generally axially tapered lead portion and a general axially tapered trailing portion and a flat non-tapered surface face portion therebetween, each said blade also including a generally axially tapered forward lead end and a generally axially tapered trailing end;

said surface face being arcuate in shape in a radial direction, at least one of said edge portions being radiused a predetermined amount, and the taper of the tapered lead portion of said surface face being greater than the taper of the trailing tapered portion of said surface face.

2. A stabilizer as set forth in claim 1 wherein said radius is between 1 degree and 4 degrees.

3. A stabilizer as set forth in claim 1 wherein one of said edge portions is a leading non-rotating edge portion, and said leading non-rotating edge portion being radiused a predetermined amount along at least the flat non-tapered surface face portion thereof.

4. A stabilizer as set forth in claim 1 wherein said stabilizer is eccentric with respect to said drill string.

5. A stabilizer as set forth in claim 1 wherein said tapered forward lead end is tapered between 30 and 45 degrees.

6. A stabilizer as set forth in claim 1 wherein said tapered trailing end is tapered between 30 and 45 degrees.

7. A stabilizer as set forth in claim 1 wherein the angle between said flat non-tapered surface face portion and the trailing tapered portion is between 1 degree and 4 degrees.

8. A stabilizer as set forth in claim 1 wherein the angle between the leading tapered portion and the flat non-tapered surface face portion is between 6 degrees and 15 degrees.

9. A system for controlled directional drilling in which a drill drill bit is adapted to be rotated by a drill string and by a downhole power source independently of said drill string comprising:

a bottom hole assembly affixed to said drill string and including a bit at one end thereof having a face at a known angular inclined orientation, a downhole source of power adapted to rotate said bit independently of said drill string, an upper stabilizer and a lower stabilizer positioned a known and predetermined distance below said upper stabilizer, means to below said upper stabilizer to incline the face of said bit at said angular orientation, at least one of said stabilizers including a plurality of spaced and generally axially extending and spiraled blade elements each including a blade surface face of a hardened abrasion resistant material, each said blade surface face having a trailing and leading edge portion, each said blade surface face also including a generally axially tapered lead portion and a generally axially tapered trailing portion with a flat non-tapered surface face portion therebetween, each said blade also including a generally axially tapered forward lead end and a generally axially tapered trailing end;

said blade surface face being arcuate in shape in a radial direction, at least one of said edge portions being radiused a predetermined amount, and the taper of the tapered lead portion of said blade surface face being greater than the taper of the trailing tapered portion of said blade surface face whereby said bottom hole assembly and drill bit may be raised upwardly without hang-up in a borehole to orient the azimuth of the inclined face to said drill bit and lowered into a borehole without hang-up or loss of bit face azimuth orientation.

10. A system as set forth in claim 9 further including a lower bearing assembly, and said lower stabilizer being located at the position of said lower bearing assembly.

11. A system as set forth in claim 9 wherein said radius is between 1 degree and 4 degrees.

12. A system as set forth in claim 9 wherein one of said edge portions is a leading non-rotating edge portion, and said leading non-rotating edge portion being radiused a predetermined amount along at least the flat non-tapered surface face portion thereof.

13. A system as set forth in claim 9 wherein said stabilizer is eccentric with respect to said drill string.

14. A system as set forth in claim 9 wherein said tapered forward lead end is tapered between 30 and 45 degrees.

15. A system as set forth in claim 9 wherein said tapered trailing end is tapered between 30 and 45 degrees.

16. A system as set forth in claim 9 wherein the angle between said flat non-tapered surface face portion and the trailing tapered portion is between 1 degree and 4 degrees.

17. A system as set forth in claim 9 wherein the angle between the leading tapered portion and the flat non-tapered surface face portion is between 6 degrees and 15 degrees.

* * * * *